US006100678A

United States Patent [19]

Hobrecht

[11] Patent Number: 6,100,678

[45] Date of Patent: Aug. 8, 2000

[54] SINGLE PACKAGE PIN PROVIDING SOFT-START AND SHORT-CIRCUIT TIMER FUNCTIONS IN A VOLTAGE REGULATOR CONTROLLER

[75] Inventor: Stephen W. Hobrecht, Los Altos, Calif.

[73] Assignee: Linear Technology Corporation, Milpitas, Calif.

[21] Appl. No.: 09/383,458

[22] Filed: Aug. 26, 1999

Related U.S. Application Data

[60] Provisional application No. 60/099,907, Sep. 11, 1998.

[51] Int. Cl.[7] ..... G05F 1/575

[52] U.S. Cl. ..... 323/288; 323/280

[58] Field of Search ..... 323/273, 274, 323/277, 280, 282, 284, 288

[56] References Cited

U.S. PATENT DOCUMENTS

| | | | |
|---|---|---|---|
| 4,806,842 | 2/1989 | Bittner | 323/288 |
| 5,264,780 | 11/1993 | Bruer et al. | 323/284 |
| 5,335,162 | 8/1994 | Martin-Lopez et al. | 323/288 |

OTHER PUBLICATIONS

Linear Technology Corporation, 1630 McCarthy Blvd., Milpitas CA 95035, "LTC1155, Dual High Side Micropower MOSFET Driver", <http://www.linear–tech.com>. Mar. 1999.

Linear Technology Corporation, 1630 McCarthy Blvd., Milpitas CA 95035, "LTC1435, High Efficiency Low noise Synchronous Step–Down Switching Regulator", <http://www.linear–tech.com>. Aug. 1996.

Linear Technology Corporation, 1630 McCarthy Blvd., Milpitas CA 95035, "LTC1438/LTC1439, Dual High Efficiency, Low Noise, Synchronous Step–Down Switching Regulators", <http://www.linear–tech.com>. Jan. 1997.

Maxim Integrated Products, 120 San Gabriel Drive, Sunnyvale, CA 94086, "Max1630–1635, Multi–Output, Low–Noise Power–Supply Controllers for Notebook Computers", <http://www.maxim–ic.com>. Apr. 1997.

Semtech Corporation, 652 Mitchell Road, Newbury Park, CA 91320, "SC1144, Programmable, High Performance Multi–Phase, PWM Controller", <http://www.semtech-.com>. Aug. 1999.

*Primary Examiner*—Jeffrey Sterrett
*Attorney, Agent, or Firm*—Fish & Neave; Matthew T. Byrne

[57] ABSTRACT

Circuits and methods for implementing both a soft-start function and a short-circuit timer function in voltage regulator controller circuits using only a single package pin are provided. The soft-start and short-circuit timer functions are performed by measuring the voltage across an external capacitor as the capacitor is charged and discharged by a function control circuit. The soft-start function is performed by charging the capacitor from a completely discharged state using a current source in the function control circuit and by using the capacitor voltage as a current limit signal to gradually increase the current drawn from a voltage source to the normal operating level. The short-circuit timer function is performed by using the charge and discharge times of the capacitor to delay the shutdown of the voltage regulator in response to a short-circuit detection.

32 Claims, 2 Drawing Sheets

SINGLE PACKAGE PIN PROVIDING SOFT-START AND SHORT-CIRCUIT TIMER FUNCTIONS IN A VOLTAGE REGULATOR CONTROLLER

CROSS REFERENCE TO RELATED APPLICATION

This application claims the benefit of U.S. provisional patent application No. 60/099,907, filed Sep. 11, 1998.

BACKGROUND OF THE INVENTION

The present invention relates to voltage regulator controller circuits. More particularly, the present invention relates to circuits and methods for providing both a soft-start function and a short-circuit timer function using a single package pin in a voltage regulator controller circuit.

The purpose of a voltage regulator is to provide a predetermined and substantially constant output voltage to a load from a voltage source which may be poorly-specified or fluctuating. In a typical linear voltage regulator, the voltage at the regulator output is regulated by controlling the flow of current passing through a pass element (such as a power transistor) from the voltage source to the load. In typical switching voltage regulators, the voltage at each regulator output is regulated by controlling the width of current pulses passing through an inductive energy storage element (such as an inductor) from the voltage source to the load. In both of these types of voltage regulators, a voltage regulator controller circuit must be employed to control the flow of current in the linear regulators and the width of the current pulses in the switching regulators.

One feature typically found in switching-based voltage regulator controller circuits is a soft-start function. A soft-start function typically reduces current surges at a voltage source by gradually increasing the current limit of the voltage regulator controller circuit so that the current drawn from the voltage source gradually builds from a low level to a normal operating level. In some implementations of a soft-start function, a package pin is used to enable a voltage regulator designer to control whether the soft-start function is to be active and, if so, to control the rate at which the soft-start function increases the current limit of the voltage regulator controller circuit. One problem with using a package pin for such a soft-start function is that once the soft-start function has performed its task, the pin is no longer in active use in the circuit.

Another feature found in some voltage regulator controller circuits is a short-circuit latch off function. This function protects a voltage regulator from short circuits at the output of the voltage regulator by causing the regulator to be shutdown when a short circuit at the output of the voltage regulator is detected. One problem with the known short-circuit latch off function in voltage regulator controller circuits is it's susceptibility to noise and brief periods of large current surges. When either of these conditions occur, these known voltage regulator controller circuits may cause the voltage regulators to be shutdown even though the conditions were only temporary and not sufficient to damage the regulator. Another problem with known short-circuit latch off functions in voltage regulator controller circuits is that they are not externally controllable. In certain instances it is desirable to disable a short circuit latch off function, for example, when testing a circuit.

In view of the foregoing, it would be desirable to provide voltage regulator controller circuits that provide a soft-start function that utilizes an external pin to control the soft-start feature and that also allows the external pin to be used for other purposes once the soft-start period has passed.

It would also be desirable to provide voltage regulator controller circuits that provide a short circuit protection mechanism that is not subject to noise and brief periods of large current surges.

It would be further desirable to provide voltage regulator controller circuits that provide a short circuit protection mechanism that enables the mechanism to be disabled.

It would be even further desirable to provide voltage regulator controller circuits that provide a soft-start function and a short circuit protection mechanism that share a single package pin.

SUMMARY OF THE INVENTION

It is therefore an object of the invention to provide voltage regulator controller circuits that provide a soft-start function that utilizes an external pin to control the soft-start feature and that also allows the external pin to be used for other purposes once the soft-start period has passed.

It is another object of the invention to provide voltage regulator controller circuits that provide a short circuit protection mechanism that is not subject to noise and brief periods of large current surges.

It is yet another object of the invention to provide voltage regulator controller circuits that provide a short circuit protection mechanism that enables the mechanism to be disabled.

It is still another object of the invention to provide voltage regulator controller circuits that provide a soft-start function and a short circuit protection mechanism that share a single package pin.

In accordance with these and other objects of the invention, there are provided circuits and methods for implementing a short-circuit timer function that integrates a short-circuit detection signal over a certain period of time and that allows the function to be disabled. The circuits and methods of the present invention also implement both a soft-start function and the short-circuit timer function in voltage regulator controller circuits using only a single package pin. This is accomplished by using the single package pin to connect a function control circuit within each voltage regulator controller circuit to an external capacitor. The function control circuit performs the soft-start and short-circuit timer functions by measuring the voltage across the external capacitor as the capacitor is charged and discharged by the function control circuit.

The function control circuit performs the soft-start function by charging the capacitor from a completely discharged state to a point where the voltage across the capacitor is just below an "armed" level. Initially, from the completely discharged state, the capacitor is charged by a current source in the function control circuit. Because the capacitor voltage is below an "ON/OFF" voltage level at this point, the rest of the voltage regulator is held OFF by an "ON/OFF" signal from the function control circuit. However, once the capacitor voltage becomes greater than the "ON/OFF" voltage level, the rest of the voltage regulator is turned ON by the "ON/OFF" signal. Then, as the capacitor voltage continues to increase beyond the "ON/OFF" voltage level, the capacitor voltage is used by the voltage regulator controller circuit as a current limit signal to gradually increase the current drawn from the voltage source to the normal operating level.

Once the capacitor voltage reaches and continues to increase past the "armed" voltage level, the function control circuit performs the short-circuit timer function. In doing so, when a short circuit detection circuit connected to the function control circuit detects a short at the output of the voltage regulator, a short circuit detection signal is provided by the short circuit detection circuit to the function control circuit. After the short circuit detection signal is received, a second current source in the function control circuit starts discharging the external capacitor. Once the capacitor discharges past a "threshold" voltage level, the function control circuit outputs a short circuit shutdown signal that causes the rest of the voltage regulator to shutdown. The discharging of the capacitor and shutting down of the voltage regulator can be overridden by providing an additional current source that provides a charge current to the capacitor equal to the amount of current being drained out of the capacitor by the second current source.

In some preferred embodiments of the present invention, a zener diode is provided in parallel with the external capacitor to prevent the voltage across the capacitor from going beyond a maximum voltage level during charging. Also in some preferred embodiments of the present invention, a voltage source is provided between the capacitor and the second current source that prevents the capacitor voltage from dropping below a minimum voltage level when discharging.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
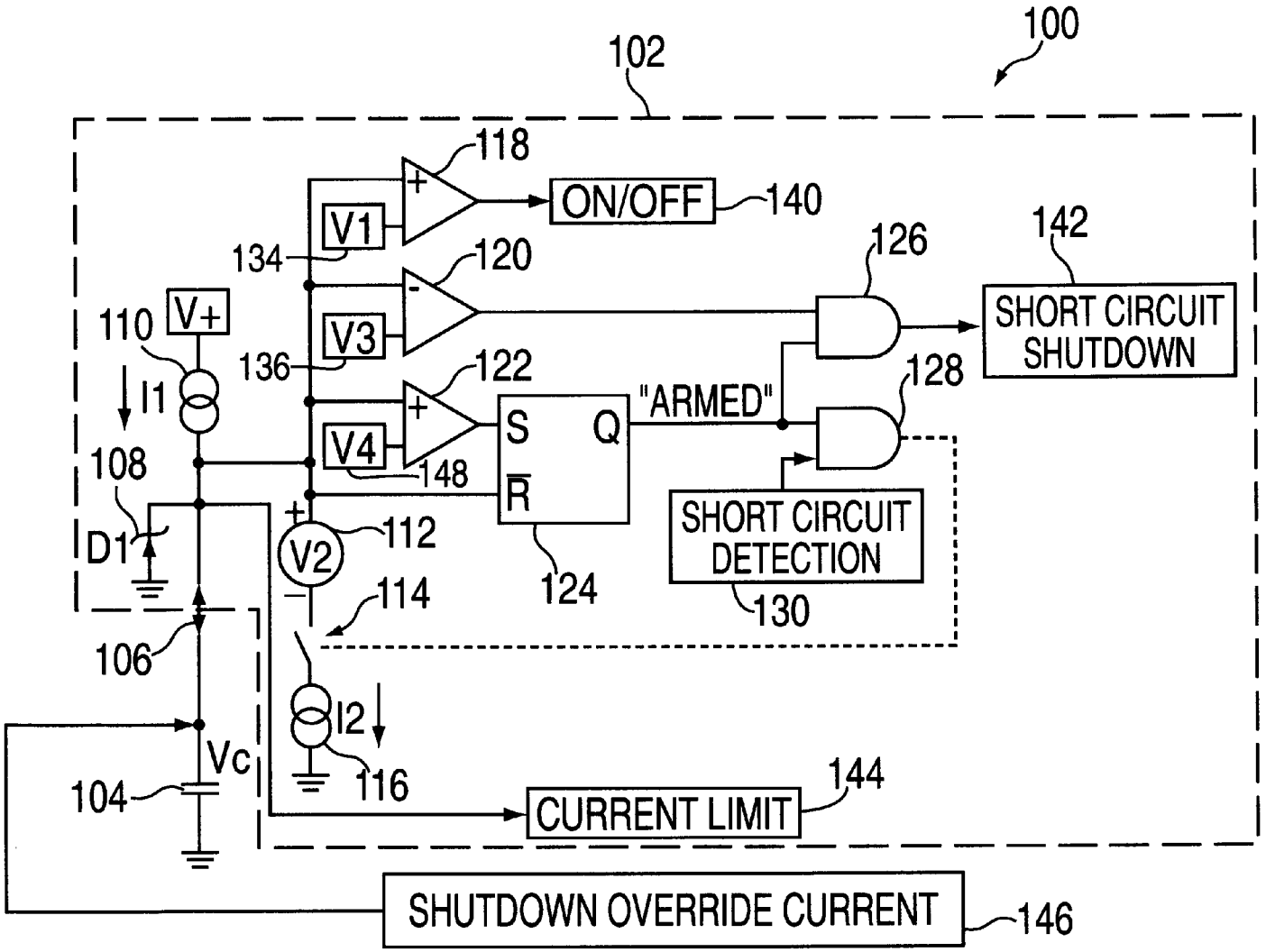
FIG. 1 is a schematic block diagram of a portion of a voltage regulator controller circuit incorporating one embodiment of a function control circuit and an external capacitor in accordance with the principles of the present invention.

FIG. 1 illustrates a portion 100 of a voltage regulator controller circuit that provides soft-start and short-circuit timer functions in accordance with the present invention. As shown, portion 100 includes a function control circuit 102, a package pin 106, and an external capacitor 104. Function control circuit 102 includes a zener diode 108, a first current source 110, a voltage source 112, a switch 114, a second current source 116, three comparators 118, 120, and 122, a latch 124, and two "AND" logic devices 126 and 128. Current sources 110 and 116 and voltage source 112 may be any suitable current sources and voltage source. Switch 114 may be any suitable controllable switch such as a field effect transistor, bipolar junction transistor, relay, etc.

In operation, current source 110 provides a first current I1 to capacitor 104 through package pin 106. This current I1 causes the voltage Vc across capacitor 104 to increase. When voltage Vc is less than a logic LOW level, this voltage Vc at reset input ("R") of latch 124 causes latch 124 to be reset so that the output ("Q") of latch 124 is LOW. Once voltage Vc rises to the point where it exceeds the level provided by voltage reference V1 134, comparator 118 outputs a HIGH ON/OFF signal 140 that causes the remainder of the voltage regulator controller circuit to turn ON. Once the remainder of the voltage regulator controller circuit has turned ON, voltage Vc across capacitor 104 is used as a current limit signal 144 for the soft-start function of the voltage regulator.

When capacitor 104 charges to the point where its voltage exceeds the level provided by voltage reference V4 138, comparator 122 drives the set input ("S") of latch 124 HIGH, and, thereby, causes output Q of latch 124 to go HIGH. When HIGH, the output of latch 124 provides an "armed" signal to one of the inputs of each of "AND" logic devices 126 and 128. In this way, comparator 122 and latch 124 act as an arming circuit. By driving the armed signal inputs of logic devices 126 and 128 HIGH, the outputs of logic devices 126 and 128 become responsive to the other input of each of logic devices 126 and 128, and, thus, gate the signal provided at the other input of each of logic devices 126 and 128. In this way, logic devices 126 and 128 act as gating circuits. For example, short circuit detection signal 130, from a short circuit detection circuit (not shown) that is connected to the output of the voltage regulator, is gated by the output of logic device 128 when the armed signal output by latch 124 is HIGH. Accordingly, when short circuit detection signal 130 goes HIGH and the armed signal is HIGH, the output of logic device 128 goes HIGH (thereby providing a discharge signal) and drives switch 114 so that switch 114 becomes CLOSED.

Once CLOSED, switch 114 enables a second current I2 (that is greater than first current I1) to flow into current source 116. This second current I2 flows into current source 116 from first current source 110, capacitor 104, and shutdown override current 146. In normal operation, shutdown override current 146 is zero, and, thus, all of current I2 is provided by current source 110 and capacitor 104. Accordingly, the current drawn out of capacitor 104 by current source 116 when switch 114 is CLOSED is normally equal to current I2 minus current I1. As this current flows out of capacitor 104, voltage Vc across capacitor 104 also drops. When voltage Vc drops below a threshold voltage provided by voltage reference V3 136, the output of comparator 120 goes HIGH, thereby causing the output of logic device 126 to also go HIGH (as the armed signal input to logic device 126 is also HIGH). This HIGH output of logic device 126 is then provided to the rest of the voltage regulator controller circuit as short circuit shutdown signal 142 to shutdown the regulator due to a shorted output.

To limit the voltage that capacitor 104 charges to when no short circuit is detected, zener diode 108 is provided in parallel with capacitor 104. Once voltage Vc reaches the breakdown voltage of diode 108, current I1 from current source 110 is diverted away from capacitor 104 by diode 108, and, thus, voltage Vc is capped at that breakdown voltage. By limiting the voltage across capacitor 104, a maximum short-circuit discharge time for capacitor 104 is set.

Voltage source 112 is provided between capacitor 104 and current source 116 to prevent capacitor 104 from discharging below a minimum voltage. By preventing voltage Vc from dropping below this minimum voltage, ON/OFF signal 140 is prevented from going LOW and resetting latch 124 by the voltage at reset input R dropping below a LOW logic level. In this way, once circuit 102 becomes armed, the circuit will not disarm itself.

Although a particular arrangement of particular devices is shown in FIG. 1, the present invention may be implemented by other embodiments than that illustrated in FIG. 1. For example, comparator 118 and voltage reference V1 134 may be omitted and ON/OFF signal 140 may always be HIGH, may be omitted, or may be provided by another circuit. As another example, the latching and logic functions provided by latch 124 and logic devices 126 and 128 may be replaced by any other suitable devices that provide arming and gating functions as described above. As yet another example, diode 108 could be omitted and the maximum voltage reached by capacitor 104 could be determined by one or more characteristics of current source 110. As still another example, voltage source 112 could be omitted and the minimum voltage reached by capacitor 104 could be determined by one or more characteristics of current sources 110 and 116.

Through function control circuit 102, the soft-start and short-circuit timer functions can be activated and controlled by a voltage regulator designer through single package pin 106. For example, to activate both functions, the designer simply has to connect external capacitor 104 to package pin 106. The size of the capacitor 104 selected by the designer in light of the characteristics of circuit 102 will then determine the current-limit-increase rate of the soft-start function and the minimum short-circuit-before-shutdown time of the short-circuit timer function. As another example, to disable the soft-start function, the designer can simply place a voltage source equal to voltage V4 accross the positive side of capacitor 104 and ground. As yet another example, to disable the short-circuit timer function, the designer simply has to connect a current source to pin 106 that provides current to capacitor 104 equal to current I2 minus current I1 when current source 116 tries to discharge capacitor 104.

Figure 2:
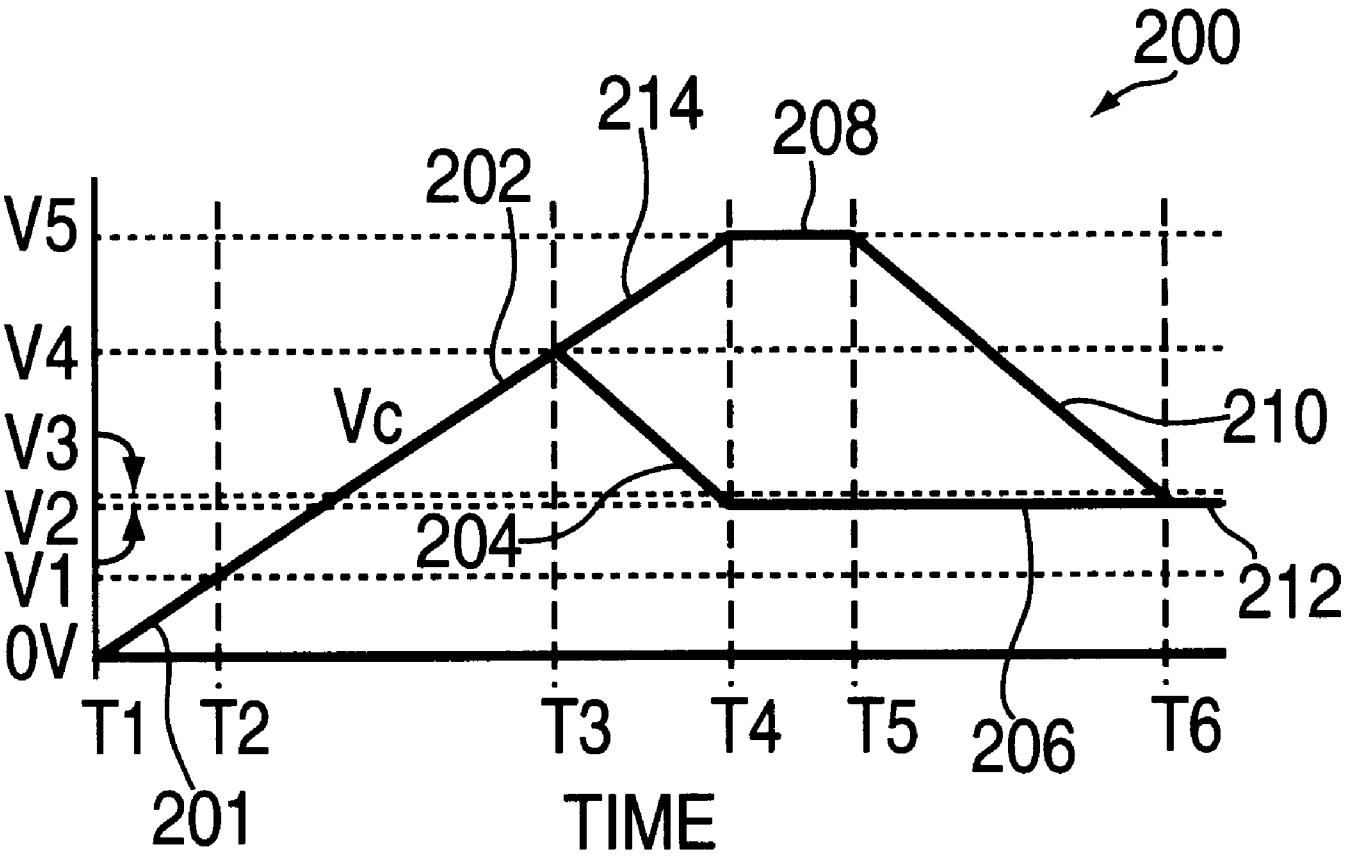
FIG. 2 is a general illustration of the voltage at different times across the capacitor of the portion of the voltage regulator controller circuit shown in FIG. 1, in accordance with the principles of the present invention.

As shown in FIG. 2, voltage Vc across capacitor 104 is illustrated over time for two possible scenarios. Between times T1 and T3, these two possible scenarios overlap, and accordingly, only a single graph line is shown in FIG. 2 by graph line segments 201 and 202. Starting at time T1, capacitor 104 is charged from a completely discharged state (shown as "0V" or 0 volts). Voltage Vc then increases with time so that voltage V1 is reached by time T2 as illustrated by graph line segment 201. Voltage V1 may be, for example, 0.6 volts, although any other suitable voltage may also be used. At this point, the remainder of the voltage regulator controller circuit is turned ON by ON/OFF signal 140 and voltage Vc is used to provide soft-start function current limit signal 144. Next, voltage Vc continues to increase to the arming voltage level at voltage V4 and time T3 as shown by graph line segment 202. Voltage V4 may be, for example, 3.5 volts, although any other suitable voltage may also be used. At this point, the armed signal provided by the output of latch 124 goes HIGH and the short-circuit timer function is activated.

Then, in a first scenario, short circuit detection signal 130 causes capacitor 104 to immediately discharge (and, thus, voltage Vc drops) as illustrated by graph line segment 204. The immediate discharging of capacitor 104 may be caused by the output of the voltage regulator being shorted to ground since any point in time up to and including time T3. As voltage Vc drops past voltage V3, short circuit shutdown signal 142 goes HIGH causing the remainder of the voltage regulator controller circuit to shutdown. Voltage V3 may be, for example, 2.6 volts, although any other suitable voltage may also be used. Once voltage Vc reaches voltage V2, voltage Vc is held at voltage V2 by voltage source 112 as illustrated by graph line segment 206. Voltage V2 may be, for example, 2.5 volts, although any other suitable voltage may also be used.

In a second scenario, once the arming voltage at voltage V4 is reached by voltage Vc at time T3, capacitor 104 continues to charge to voltage V5 at time T4 as shown by graph line segment 214. Voltage V5 may be, for example, 6.0 volts, although any other suitable voltage may also be used. At this point, voltage Vc across capacitor 104 is held at voltage V5 by zener diode 108 which has a breakdown voltage equal to voltage V5. Between times T4 and T5, zener diode 108 continues to maintain voltage Vc at voltage V5 as illustrated by graph line segment 208. Then at time T5, a short circuit detection signal 130 is received by function control circuit 102 and voltage Vc is caused to decrease as capacitor 104 discharges, as shown by graph line segment 210. As with the first scenario, once voltage Vc drops past voltage V3, short circuit shutdown signal 142 goes HIGH causing the remainder of the voltage regulator controller circuit to shutdown. Also, once voltage Vc reaches voltage V2, voltage Vc is held at voltage V2 by voltage source 112 as illustrated by graph line segment 212.

Although not shown, at any point in time after time T3 or T5 for the first or second scenarios, respectively, capacitor 104 could be recharged similarly to that shown in graph line segments 202 and 204 upon short circuit detection signal 130 going LOW. Upon such a recharging of capacitor 104, a subsequent receipt of a HIGH short circuit detection signal 130 would cause capacitor 104 to be redischarged, and possibly the controller circuit to be shutdown, as described above.

As shown in FIG. 2, the minimum and maximum discharge times of capacitor 104 to shutdown are shown by graph line segments 204 and 210, respectively. As can be seen, the minimum discharge time is equal to time T4 minus time T3 and the maximum discharge time is equal to time T6 minus time T5. Although, only two scenarios are illustrated in FIG. 2, an infinite number of other scenarios are possible as capacitor 104 could be caused to discharge at any voltage between and including voltages V4 and V5. Moreover, the times between any pair of times T1, T2, T3, T4, T5, and T6 could have any duration as a function of the size of capacitor 104, the sizes of current sources 110 and 116, the breakdown voltage of diode 108, the voltage of voltage source 112, the voltages of voltage references 134, 136, and 138, the timing of any short circuit detection signal 130, and the size and the timing of any shutdown override current 146.

Persons skilled in the art will appreciate that the principles of the present invention can be practiced by other than the described embodiments, which are presented for purposes of illustration and not of limitation, and the present invention is limited only by the claims which follow.

What is claimed is:

1. A voltage regulator control circuit that provides a short-circuit timer function through a single package pin coupled to an external capacitor, comprising:

charging and draining circuitry, coupled to the single package pin, that charges and drains voltage on the capacitor;

monitoring circuitry, coupled to the capacitor that:

a) causes the charging and draining circuitry to charge the capacitor when a SHORT CIRCUIT DETECTION signal indicates that a short circuit is not present;

b) causes the charging and draining circuitry to discharge the capacitor once the capacitor voltage has reached an arming voltage-and while the SHORT CIRCUIT DETECTION signal indicates that a short circuit is present; and c) provides a SHORT CIRCUIT SHUTDOWN signal when the capacitor voltage has fallen below a threshold voltage.

2. The control circuit of claim 1, wherein the control circuit further provides a soft-start function and wherein the capacitor voltage is used to provide a CURRENT LIMIT signal for a portion of the time the capacitor is being charged.

3. The control circuit of claim 1, wherein the capacitor can be charged with a SHUTDOWN OVERRIDE signal once the capacitor voltage has reached an arming voltage and while the SHORT CIRCUIT DETECTION signal indicates that a short circuit is present.

4. The control circuit of claim 1, wherein the monitoring circuitry provides an ON signal to other voltage regulator circuitry when the capacitor voltage exceeds an ON/OFF voltage.

5. A method for providing a short-circuit timer function in a voltage regulator control circuit through a single package pin coupled to an external capacitor, comprising:

charging the capacitor when a SHORT CIRCUIT DETECTION signal indicates that a short circuit is not present;

discharging the capacitor once voltage on the capacitor has reached an arming voltage and while the SHORT CIRCUIT DETECTION signal indicates that a short circuit is present; and providing a SHORT CIRCUIT SHUTDOWN signal when the capacitor voltage has fallen from the arming voltage to below a threshold voltage.

6. The method of claim 5, further providing a soft-start function, comprising:

providing the capacitor voltage as a CURRENT LIMIT signal for a portion of the time the capacitor is being charged.

7. The method of claim 5, further comprising:

charging the capacitor with a SHUTDOWN OVERRIDE signal once the capacitor voltage has reached an arming voltage and while the SHORT CIRCUIT DETECTION signal indicates that a short circuit is present.

8. The method of claim 5, further comprising providing an ON signal to other voltage regulator circuitry when the capacitor voltage exceeds an ON/OFF voltage.

9. A voltage regulator controller circuit that provides a soft-start function and a short-circuit timer function through a single package pin connected to an external capacitor, comprising:

a first current source that provides current to the capacitor through the single package pin so that a capacitor voltage is created in the capacitor;

an arming circuit that produces an ARMED signal when the arming circuit detects that the capacitor voltage exceeds an arming voltage;

a first gating circuit that produces a DISCHARGE signal when both a SHORT CIRCUIT DETECTION signal and the ARMED signal are present;

a second current source that drains current from the capacitor;

a switch that causes the second current source to drain current from the capacitor when the DISCHARGE signal is present;

a first comparator that produces a first comparator output when the capacitor voltage is below a threshold voltage; and a second gating circuit that produces a SHORT CIRCUIT SHUTDOWN signal when the first comparator output and the ARMED signal are present.

10. The circuit of claim 9, wherein the arming circuit comprises:

a second comparator that produces a SET signal when the capacitor voltage exceeds the arming voltage; and a latch that outputs the ARMED signal when the SET signal is present.

11. The circuit of claim 10, wherein the latch is reset when the capacitor voltage is below a LOW logic level.

12. The circuit of claim 9, wherein the first gating circuit is an "AND" logic device that receives the SHORT CIRCUIT DETECTION signal and the ARMED signal as inputs, and that outputs the DISCHARGE signal.

13. The circuit of claim 9, wherein the switch is a field effect transistor.

14. The circuit of claim 9, wherein the switch is a bipolar junction transistor.

15. The circuit of claim 9, wherein the second gating circuit is an "AND" logic device that receives the first comparator output and the ARMED signal as inputs, and that outputs the SHORT CIRCUIT SHUTDOWN signal.

16. The circuit of claim 9, further comprising a zener diode that limits the capacitor voltage to a maximum voltage.

17. The circuit of claim 9, further comprising a voltage source that limits the capacitor voltage to a minimum voltage.

18. The circuit of claim 9, further comprising a third comparator that provides an ON/OFF signal when the capacitor voltage exceeds an ON/OFF voltage level.

19. The circuit of claim 9, wherein the capacitor voltage is used to set a current limit as part of the soft-start function of the voltage regulator controller circuit.

20. The circuit of claim 9, wherein a shutdown override current is provided to the capacitor that prevents the capacitor from being discharged by the second current source.

21. A method for providing a soft-start function and a short-circuit timer function in a voltage regulator controller circuit through a single package pin connected to an external capacitor, comprising:

providing current to the capacitor through the single package pin so that a capacitor voltage is created in the capacitor;

producing an ARMED signal when the capacitor voltage at the single package pin exceeds an arming voltage;

producing a DISCHARGE signal when both a SHORT CIRCUIT DETECTION signal and the ARMED signal are present;

draining current from the capacitor through the single package pin when the DISCHARGE signal is present;

producing a first comparator output when the capacitor voltage is below a threshold voltage; and producing a SHORT CIRCUIT SHUTDOWN signal when both the first comparator output and the ARMED signal are present.

22. The method of claim 21, wherein the producing of the ARMED signal comprises:

producing a SET signal when the capacitor voltage exceeds the arming voltage; and latching the ARMED signal when the SET signal is present.

23. The method of claim 22, wherein the ARMED signal that is latched is reset when the capacitor voltage is below a LOW logic level.

24. The method of claim 21, wherein the producing of the DISCHARGE signal is performed using an "AND" logic device that receives the SHORT CIRCUIT DETECTION signal and the ARMED signal as inputs, and that outputs the DISCHARGE signal.

25. The method of claim 21, wherein the draining of the current is performed using a field effect transistor.

26. The method of claim 21, wherein the draining of the current is performed using a bipolar junction transistor.

27. The method of claim 21, wherein the producing of the SHORT CIRCUIT SHUTDOWN signal is performed using an "AND" logic device that receives the first comparator output and the ARMED signal as inputs, and that outputs the SHORT CIRCUIT SHUTDOWN signal.

28. The method of claim 21, further comprising limiting the capacitor voltage to a maximum voltage.

29. The method of claim 21, further comprising limiting the capacitor voltage to a minimum voltage.

30. The method of claim 21, further comprising providing an ON/OFF signal when the capacitor voltage exceeds an ON/OFF voltage level.

31. The method of claim 21, further comprising setting a current limit using the capacitor voltage as part of the soft-start function of the voltage regulator controller circuit.

32. The method of claim 21, further comprising providing a shutdown override current to the capacitor that prevents the capacitor from being discharged.

* * * * *

UNITED STATES PATENT AND TRADEMARK OFFICE

CERTIFICATE OF CORRECTION

PATENT NO : 6,100,678

DATED : August 8, 2000

INVENTION(S) : SINGLE PACKAGE PIN PROVIDING SOFT-START AND SHORT-CIRCUIT TIMER FUNCTIONS IN A VOLTAGE REGULATOR CONTROLLER

It is certified that error appears in the above-identified patent and that said Letters Patent are hereby corrected as shown below:

Column 1, line 54, change "it's" to --its--.

Column 6, line 62, change "voltage-and" to --voltage and--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*